US010304600B2

(12) United States Patent
Horiuchi et al.

(10) Patent No.: US 10,304,600 B2
(45) Date of Patent: May 28, 2019

(54) PERMANENT MAGNET, AND MOTOR AND GENERATOR USING THE SAME

(71) Applicant: KABUSHIKI KAISHA TOSHIBA, Minato-ku, Tokyo (JP)

(72) Inventors: Yosuke Horiuchi, Tokyo (JP); Shinya Sakurada, Tokyo (JP); Keiko Okamoto, Kanagawa (JP); Masaya Hagiwara, Kanagawa (JP); Tsuyoshi Kobayashi, Kanagawa (JP); Masaki Endo, Tokyo (JP); Tadahiko Kobayashi, Kanagawa (JP); Kazuomi Yoshima, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 361 days.

(21) Appl. No.: 14/611,434

(22) Filed: Feb. 2, 2015

(65) Prior Publication Data

US 2015/0143952 A1 May 28, 2015

Related U.S. Application Data

(63) Continuation of application No. PCT/JP2014/001517, filed on Mar. 17, 2014.

(30) Foreign Application Priority Data

Mar. 26, 2013 (JP) ..... 2013-063666

(51) Int. Cl.
*C22C 19/07* (2006.01)
*H01F 1/055* (2006.01)

(52) U.S. Cl.
CPC ..... *H01F 1/0557* (2013.01); *C22C 19/07* (2013.01); *C22C 2202/02* (2013.01)

(58) Field of Classification Search
CPC ..... C22C 19/07; C22C 2202/02; B22F 2301/15; B22F 2301/155
See application file for complete search history.

(56) References Cited

U.S. PATENT DOCUMENTS 4,746,378 A 5/1988 Wysiekierski et al.
5,647,886 A 7/1997 Kitazawa et al.
(Continued)

FOREIGN PATENT DOCUMENTS

CN 102474165 5/2012
EP 1187147 3/2002
(Continued)

OTHER PUBLICATIONS

Japanese Office Action for Japanese Patent Application No. 2013-063666 dated Jul. 19, 2016.
(Continued)

*Primary Examiner* — Scott R Kastler
*Assistant Examiner* — Vanessa T. Luk
(74) *Attorney, Agent, or Firm* — Amin, Turocy & Watson LLP

(57) ABSTRACT

In one embodiment, a permanent magnet includes a sintered compact having a composition represented by the composition formula: $R_pFe_qM_rCu_sCo_{100-p-q-r-s}$ (where R is at least one element selected from rare earth elements, M is at least one element selected from Zr, Ti, and Hf, p is 10.5 atomic % or more and 12.5 atomic % or less, q is 24 atomic % or more and 40 atomic % or less, r is 0.88 atomic % or more and 4.5 atomic % or less, and s is 3.5 atomic % or more and 10.7 atomic % or less. The sintered compact has a structure having crystal grains constituted of a main phase including a $Th_2Zn_{17}$ crystal phase, and a crystal grain boundary. In the structure of the sintered compact, an average grain diameter
(Continued)

of the crystal grains is 25 micrometer or more, and a volume fraction of the crystal grain boundary is 14% or less.

11 Claims, 4 Drawing Sheets

(56) References Cited

U.S. PATENT DOCUMENTS

| | | | | |
|---|---|---|---|---|
| 6,139,765 | A | 10/2000 | Kitazawa et al. | |
| 2011/0241810 | A1* | 10/2011 | Horiuchi | C22C 1/0433 335/302 |
| 2012/0074804 | A1 | 3/2012 | Horiuchi et al. | |
| 2012/0146444 | A1 | 6/2012 | Horiuchi et al. | |
| 2012/0242180 | A1 | 9/2012 | Horiuchi et al. | |
| 2013/0241333 | A1* | 9/2013 | Horiuchi | C22C 19/07 310/152 |
| 2017/0271060 | A1* | 9/2017 | Takahashi | H01F 1/0536 |

FOREIGN PATENT DOCUMENTS

| | | | | |
|---|---|---|---|---|
| JP | 55-18063 | | 2/1980 | |
| JP | 06-212327 | | 8/1994 | |
| JP | 8-031626 | | 2/1996 | |
| JP | 09-111383 | | 4/1997 | |
| JP | 2010-034522 | | 2/2010 | |
| JP | WO 2011121647 | A1 * | 10/2011 | C22C 19/07 |
| JP | 2012-069750 | | 4/2012 | |
| JP | 2012-204599 | | 10/2012 | |
| WO | 2011/016089 | | 10/2011 | |

OTHER PUBLICATIONS

Chinese Office Action for Chinese Patent Application No. 201480002174.X dated Sep. 1, 2016.

Li, et al. "Microstructure and coercivity mechanism of Sm2Co17 type high temperature rare-earth permanent magnets", The Chinese Journal of Nonferrous Metals, vol. 18, No. 1, Jan. 2008, pp. 72-77.

Corfield, et al. "Study of solid-state reactions in Sm (Co, Fe, Cu, Zr)2 2:17-type alloys by means of in situ electrical resistivity measurements", Journal of Magnetism and Magnetic Materials 316, 2007, pp. 59-66.

Japanese Notice of Allowance for Japanese Patent Application No. 2013-063666 dated Dec. 20, 2016.

Gutfleisch, et al. "Characterization of Rare Earth-Transition Metal Alloys with Resistivity Measurements", IEEE Transactions on Magnetics, vol. 29, No. 6, Nov. 1993, pp. 2872-2874.

International Search Report for PCT Application No. PCT/JP2014/001517 dated Jul. 22, 2014.

Maury, C., et al.; Genesis of the Cell Microstructure in the Sm(Co, Fe, Cu, Zr) Permanent Magnets with 2:17 Type; Physica Status Solidi (A); Nov. 16, 1993; pp. 57-72; vol. 140; No. 1.

Gopalan, R, et al.; Studies on structural transformation and magnetic properties in Sm2Co17 type alloys; Journal of Materials Science; Sep. 1, 2001; pp. 4117-4123; Kluwer Academic Publishers.

Xiu-Mei, Li, et al.; Magnetic domain structures of precipitation-hardened SmCo 2:17 type sintered magnets: Heat treatment effect*; Chinese Physics Soc. and IOP Publishing Ltd; Jun. 1, 2008; pp. 2281-2287; vol. 17, No. 6.

Written Opinion for PCT Application No. PCT/JP2014/001517 dated Jul. 22, 2014.

International Preliminary Report on Patentability for PCT Application No. PCT/JP2014/001517 dated Oct. 8, 2015.

Extended European Search Report for European Patent Application No. 17198043.6 dated Feb. 13, 2018.

* cited by examiner

PERMANENT MAGNET, AND MOTOR AND GENERATOR USING THE SAME

CROSS-REFERENCE TO RELATED APPLICATIONS

This application is a continuation of prior International Application No. PCT/JP2014/001517 filed on Mar. 17, 2014, which is based upon and claims the benefit of priority from Japanese Patent Application No. 2013-063666 filed on Mar. 26, 2013; the entire contents of all of which are incorporated herein by reference.

FIELD

Embodiments described herein relate generally to a permanent magnet, and a motor and a generator using the same.

BACKGROUND

As high-performance permanent magnets, rare-earth magnets such as Sm—Co magnets and Nd—Fe—B magnets are known. When a permanent magnet is used in a motor for a hybrid electric vehicle (HEV) or electric vehicle (EV), it is demanded for the permanent magnet to have heat resistance. In motors for HEV or EV, permanent magnets whose heat resistance is increased by replacing a part of neodymium (Nd) of Nd—Fe—B magnet with dysprosium (Dy) are used. Dy is one of rare elements, and thus permanent magnets not using Dy are demanded.

The Sm—Co magnets have a high Curie temperature and thus are known to exhibit excellent heat resistance as a magnet not using Dy, and are expected to realize favorable operating characteristics at high temperatures. The Sm—Co magnets are low in magnetization compared to the Nd—Fe—B magnets, and are not able to achieve sufficient values of maximum magnetization energy product ($(BH)_{max}$). In order to increase magnetization of the Sm—Co magnets, it is effective to replace a part of cobalt (Co) with iron (Fe), and increase Fe concentration. However, coercive force of Sm—Co magnets tends to decrease in a composition region having high Fe concentration. Moreover, regarding magnetization of the Sm—Co magnets, only replacing a part of Co with Fe does not always result in obtaining a sufficient value, and hence further improvement is demanded.

DETAILED DESCRIPTION

Figure 1:
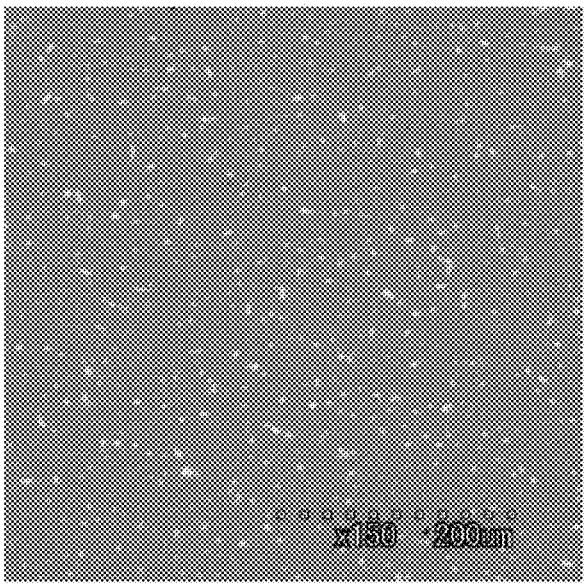
FIG. 1 is an SEM-reflected electron image illustrating a structure of an Sm—Co sintered magnet.

According to one embodiment, there is provided a permanent magnet including a sintered compact having a composition represented by the following composition formula:

$$R_pFe_qM_rCu_sCo_{100-p-q-r-s} \quad (1)$$

wherein R is at least one element selected from the group consisting of rare earth elements, M is at least one element selected from the group consisting of Zr, Ti, and Hf, p is 10.5 atomic % or more and 12.5 atomic % or less, q is 24 atomic % or more and 40 atomic % or less, r is 0.88 atomic % or more and 4.5 atomic % or less, and s is 3.5 atomic % or more and 10.7 atomic % or less.

The sintered compact constituting a permanent magnet of the embodiment has a structure having crystal grains constituted of a main phase including a $Th_2Zn_{17}$ crystal phase, and a crystal grain boundary existing between the crystal grains. An average grain diameter of the crystal grains constituting the sintered compact is 25 micrometer or more, and a volume fraction of the crystal grain boundary is 14% or less.

Hereinafter, the permanent magnet of the embodiment will be described in detail. In the composition formula (1), at least one element selected from rare earth elements including yttrium (Y) is used as the element R. The element R brings about large magnetic anisotropy in the permanent magnet, and gives high coercive force. As the element R, at least one selected from samarium (Sm), cerium (Ce), neodymium (Nd), and praseodymium (Pr) is preferably used, and use of Sm is desirable. When 50 atomic % or more of the element R is Sm, it is possible to increase characteristics of the permanent magnet such as coercive force with good reproducibility. Desirably, 70 atomic % or more of the element R is Sm.

In order to increase the coercive force of the permanent magnet, the content p of the element R is in the range of 10.5 to 12.5 atomic %. When the content p of the element R is less than 10.5 atomic %, a large amount of alpha-Fe phase precipitates, and sufficient coercive force cannot be obtained. When the content p of the element R exceeds 12.5 atomic %, saturation magnetization decreases significantly. The content p of the element R is preferably in the range of 10.7 to 12.3 atomic %, more preferably in the range of 10.9 to 12.1 atomic %.

Iron (Fe) is an element mainly responsible for magnetization of the permanent magnet. When a relatively large amount of Fe is contained, saturation magnetization of the permanent magnet can be increased. However, when Fe is contained too much, the coercive force may decrease because alpha-Fe phase precipitates and because it becomes difficult to obtain a desired two-phase separation structure, which will be described later. Accordingly, the content q of Fe is in the range of 24 to 40 atomic %. The content q of Fe is preferably in the range of 27 to 36 atomic %, more preferably in the range of 29 to 34 atomic %.

As the element M, at least one element selected from titanium (Ti), zirconium (Zr), and hafnium (Hf) is used. Blending the element M enables the magnet to exert large coercive force in a composition range with high Fe concentration. The content r of the element M is in the range of 0.88 to 4.5 atomic %. When the content r of the element M is 0.88 atomic % or more, the Fe concentration can be increased.

When the content r of element M is more than 4.5 atomic %, a hetero-phase rich in element M is generated, and both magnetization and coercive force decrease. The content r of the element M is preferably in the range of 1.14 to 3.58 atomic %, more preferably in the range of 1.49 to 2.24 atomic %.

The element M may be any one of Ti, Zr, and Hf, but is preferred to contain at least Zr. When 50 atomic % or more of the element M is Zr, it is possible to further improve the effect to increase the coercive force of the permanent magnet. Hf in the element M is particularly expensive, and thus when Hf is used the amount of Hf used is preferred to be small. Preferably, the content of Hf is less than 20 atomic % of the element M.

Copper (Cu) is an element for enabling the permanent magnet to exert high coercive force. The blending amount s of Cu is in the range of 3.5 to 10.7 atomic %. When the blending amount s of Cu is less than 3.5 atomic %, it is difficult to obtain high coercive force. When the blending amount s of Cu exceeds 10.7 atomic %, magnetization decreases significantly. The blending amount s of Cu is preferably in the range of 3.9 to 9 atomic %, more preferably in the range of 4.3 to 5.8 atomic %.

Cobalt (Co) is an element responsible for magnetization of the permanent magnet and necessary for enabling exertion of high coercive force. Moreover, when a large amount of Co is contained, the Curie temperature becomes high, and thermal stability of the permanent magnet improves. When the content of Co is too small, these effects cannot be obtained sufficiently. However, when the content of Co is too large, the content ratio of Fe decreases relatively, and magnetization decreases. Therefore, the content of Co is set so that the content q of Fe satisfies the above range in consideration of the contents of element R, element M and Cu.

A part of Co may be replaced with at least one kind of element A selected from nickel (Ni), vanadium (V), chrome (Cr), manganese (Mn), aluminum (Al), silicon (Si), gallium (Ga), niobium (Nb), tantalum (Ta) and tungsten (W). These replacement elements A contribute to improvement of magnetic characteristics, for example coercive force. However, excessive replacement of Co with the element A may cause decrease in magnetization, and thus the amount of replacement with the element A is preferred to be 20 atomic % or less of Co.

The permanent magnet of the embodiment is a sintered magnet constituted of the sintered compact having the composition represented by the composition formula (1). In the sintered magnet (sintered compact), a region containing a $Th_2Zn_{17}$ crystal phase is a main phase. When a cross section of the sintered compact is observed with a scanning electron microscope (SEM), the main phase of the sintered magnet is a phase having a largest area ratio in an observation image (SEM image). The main phase of the sintered magnet preferably has a phase separation structure formed by performing an aging treatment on a precursor, which is a $TbCu_7$ crystal phase (1-7 phase/high temperature phase) formed by a solution treatment. The phase separation structure preferably has a cell phase constituted of a $Th_2Zn_{17}$ crystal phase (2-17 phase), and a cell wall phase constituted of a $CaCu_5$ crystal phase (1-5 phase) or the like. The magnetic wall energy of the cell wall phase is large compared to the cell phase, and this difference in magnetic wall energy becomes a barrier to magnetic wall movement. That is, it is conceivable that the cell wall phase with large magnetic wall energy operates as a pinning site, to thereby exert coercive force of magnetic wall pinning type.

The sintered magnet of the embodiment has crystal grains constituted of the main phase including the $Th_2Zn_{17}$ crystal phase, and is constituted of polycrystal (sintered compact) of such crystal grains. Between the crystal grains constituting the sintered compact a crystal grain boundary exists. The size (crystal grain diameter) of the crystal grains constituting the sintered compact is generally of micron order, and the thickness of the crystal grain boundary existing between such crystal grains is also of micron order. The size of the cell phase in the main phase is of nano-order (for example, about from 50 to 400 nm), and the thickness of the cell wall phase surrounding such a cell phase is also of nano-order (for example, about from 2 to 30 nm). The phase separation structure constituted of the cell phase and the cell wall phase exists in crystal grains constituted of the main phase including the 2-17 phase.

The sintered compact constituting the permanent magnet of the embodiment has the crystal grains constituted of the main phase including the 2-17 phase and the crystal grain boundary as a boundary between these crystal grains. In the permanent magnet of the embodiment, an average grain diameter of the crystal grains constituted of the main phase is 25 micrometer or more, and the volume fraction of the crystal grain boundary is 14% or less. By applying the sintered compact which has such a structure having crystal grains and a crystal grain boundary, magnetization of the permanent magnet (sintered magnet) can be increased further. The relation between the structure of the permanent magnet according to the embodiment and the magnetization will be described in detail below.

An Sm—Co based sintered compact constituting the permanent magnet is obtained by press forming an alloy powder pulverized to a few micrometer level while allowing crystal orientation in a magnetic field, and sintering by retaining the compression-molded body at a predetermined temperature. Moreover, in manufacturing steps of the Sm—Co based sintered compact, generally, the solution treatment is performed by retaining at a slightly lower temperature than the sintering temperature after sintering. The sintered compact after the solution treatment is rapid cooled. The sintering step and the solution treatment step are often performed continuously, and the sintered compact is often obtained in a sintering-solution treatment step. Magnetization of the sintered compact is in a proportional relation with density of the sintered compact, and thus it is desirable to obtain a sintered compact density that is as high as possible. Further, the higher the degree of orientation, the higher the residual magnetization. That is, to obtain high residual magnetization, a general method is to have a raw material composition with high iron concentration, and obtain a sintered compact with high sintered compact density and high degree of crystal orientation. However, when the iron concentration is excessively high, the coercive force decreases. Moreover, there are limits for improvement of sintered compact density and degree of crystal orientation, and there has been desired creation of a new method to improve magnetization.

Characteristics of the Sm—Co based sintered magnet largely depend on the sintering-solution treatment step. For example, when the sintering temperature is too low, pores are made and sufficient sintered compact density is not obtained. When the sufficient sintered compact density is not obtained, high magnetization cannot be obtained. When the treatment temperature is too high, the element R such as Sm as a constituent element evaporates, and an extreme composition displacement occurs. In such a case, it is highly possible that the sufficient coercive force is not obtained.

From such points, the present inventors have intensively studied the relation between the sintering conditions and the sintered compact structure and magnetic characteristics, and have found that magnetization is improved when the sintering-solution treatment is performed under certain conditions.

In the sintering process, atoms in the magnetic powder (alloy powder) diffuse and bond together, and sintering proceeds while filling gaps. At that time, the crystal grain boundary forms progressively while the magnetic powder bond together progressively. The sintered compact is a polycrystal and, given that the pulverized magnetic powder is in a state close to a monocrystal, is an aggregate of a large amount of such monocrystals. Each of the monocrystals can be called a crystal grain, and a boundary between the monocrystals can be called a crystal grain boundary. As the sintering proceeds, crystal grains grow while encroaching grains, and the crystal grain diameter increases progressively. The present inventors have found that as the crystal grain diameter of the sintered compact increases, the residual magnetization tends to increase. However, the inventors have simultaneously found that simply increasing the crystal grain diameter does not always cause increase in residual magnetization.

As a result of intensely examining causes thereof, the inventors have found that the improvement of residual magnetization is influenced not by increase in crystal grain diameter itself, but by decrease in crystal grain boundary accompanying the increase in crystal grains. Specifically, even when the crystal grain diameter of the sintered compact is large, the residual magnetization will not be improved in one having a high ratio of crystal grain boundary in the sintered compact such as, for example, one having a large aspect ratio of crystal grains, one having crystal grains with a complicated shape, and the like. Conventionally, since the crystal grain boundary has a very small thickness, it has not been conceived that the magnitude of a ratio of crystal grain boundary influences magnetization. Contrary to such points, the present inventors have found that the ratio of crystal grain boundary influences magnetization, and completed the permanent magnet of the embodiment. Here, considering the crystal grain boundary, the crystal grain boundary is a location where the configuration of atoms is disordered, that is, a defect. It is conceivable that such a crystal grain boundary does not contribute to magnetization. That is, even by a small amount, decrease in ratio of crystal grain boundary can reduce loss of magnetization.

The ratio (volume fraction) of the crystal grain boundary in the sintered magnet (sintered compact) can be obtained by SEM-electron backscattering pattern (SEM-EBSP). A specific method of calculation will be described later. The present inventors have found that magnetization of the sintered magnet improves significantly when the ratio of crystal grain boundary in the sintered magnet (sintered compact) is 14% or less. To decrease the ratio of crystal grain boundary, it is effective to facilitate grain growth of the crystal grains constituting the sintered compact. From such a point, in the sintered compact constituting the permanent magnet of the embodiment, the average grain diameter of crystal grains constituted of the main phase is 25 micrometer or more. When the ratio (volume fraction) of crystal grain boundary exceeds 14%, or when the average grain diameter of crystal grains is less than 25 micrometer, it is not possible to sufficiently obtain the effect of improving magnetization in either case.

When the ratio of crystal grain boundary exceeds 14%, the effect of suppressing magnetization loss due to decrease in ratio of crystal grain boundary which does not contribute to magnetization cannot be obtained effectively. The ratio of crystal grain boundary in the sintered magnet (sintered compact) is preferably 12% or less, more preferably 10% or less. However, to maintain the shape of the sintered compact and obtain practical strength and the like, a certain amount of crystal grain boundary is necessary in the sintered compact. The ratio of crystal grain boundary in the sintered magnet (sintered compact) is preferably 5% or more. When the average grain diameter of crystal grains is less than 25 micrometer, the effect of reducing the crystal grain boundary cannot be obtained sufficiently. More preferably, the average grain diameter of crystal grains is 35 micrometer or more. When the average grain diameter of crystal grains is too large, the strength and the like of the sintered compact (sintered magnet) decreases easily, and thus the average grain diameter of crystal grains is preferably 200 micrometer or less.

In the permanent magnet of the embodiment, magnetization is further improved by sufficiently growing crystal grains constituting the sintered compact (with an average grain diameter of 25 micrometer or more), and decreasing the ratio of the crystal grain boundary (with a volume fraction of 14% or less). In order to decrease the ratio of the crystal grain boundary by growing the crystal grains, high sintering temperatures are effective. However, in the Sm—Co based sintered magnet, the element R such as Sm evaporates due to sintering at high temperatures, and composition control is difficult. In view of composition control, the sintering temperature is desirably 1190 degrees centigrade or lower. However, the diffusion rate of atoms becomes slow at sintering temperatures of 1190 degrees centigrade or less, and crystals cannot be grown sufficiently. The present inventors have found that satisfying both extension of sintering time and extension of solution treatment time are effective as conditions for sufficiently growing crystal grains while suppressing excessive evaporation of Sm and the like.

Regarding a sintered compact obtained through a sintering-solution treatment step in which both the sintering time and the solution treatment time are extended, the degree of orientation of crystal grains was evaluated by SEM-EBSP, and consequently it was found that also the degree of orientation of crystal grains is improved. It is conceivable that also the improvement of the degree of orientation of crystal grains contributes to improvement of magnetization. The degree of orientation of crystal grains is evaluated by the degree of displacement of a crystal orientation angle from an easy magnetization axis. In the permanent magnet of the embodiment, the $Th_2Zn_{17}$ crystal phase in the main phase is a rhombohedral structure, but its easy magnetization axis is in parallel to the direction [0001] of 1-7 phase when the $Th_2Zn_{17}$ crystal phase (2-17 phase) is indexed as the $TbCu_7$ crystal phase (1-7 phase) of hexagonal system. Therefore, by measuring the degree of displacement angle of the [0001] direction of 1-7 phase between crystal grains, the degree of orientation of the crystal grains can be evaluated.

It has been found that the effect of improving magnetization based on the degree of orientation of crystal grains is related to a distance between crystal grains with a [0001] direction of 1-7 phase being inclined by 45 degrees or more. When the distance between crystal grains with the [0001] direction of 1-7 phase being inclined by 45 degrees or more is large, magnetization improves further. Specifically, in the case where a 2-17 phase is indexed as a 1-7 phase, when an average distance between crystal grains with the displacement angle of the [0001] direction of 1-7 phase being 45 degrees or more is 120 micrometer or more, magnetization of the Sm—Co based sintered magnet can be improved further. When the average distance between crystal grains with the displacement of crystal orientation angle being 45 degrees or more is less than 120 micrometer, the degree of orientation of crystal grains is not increased sufficiently. Therefore, the magnetization improving effect based on improvement of the degree of orientation of crystal grains cannot be obtained effectively. More preferably, the average distance between crystal grains with the displacement of crystal orientation angle being 45 degrees or more is 180 micrometer or more.

A method of measuring the above-described average grain diameter of crystal grains, ratio of crystal grain boundary, and degree of orientation of crystal grains will be described in detail below. In general, the crystal grain boundary can be measured by the optical microscope observation or SEM. However, here, the average grain diameter (average grain diameter) of crystal grains constituting the sintered compact (sintered magnet), the ratio of crystal grain boundary, and the degree of orientation of crystal grains are measured and evaluated with SEM-EBSP. This is because when the crystal grain boundary is observed with a secondary electron image or reflected electron image of SEM, the crystal grain boundary generally appears as a linear shape. FIG. 1 illustrates an example of SEM-reflected electron image of the Sm—Co sintered magnet. As illustrated in FIG. 1, there may be cases where the crystal grain boundary appears not to exist in appearance of the image. Specifically, it is possible that the ratio of crystal grain boundary is estimated to be apparently very small in the secondary electron image or reflected electron image of SEM.

Figure 2:
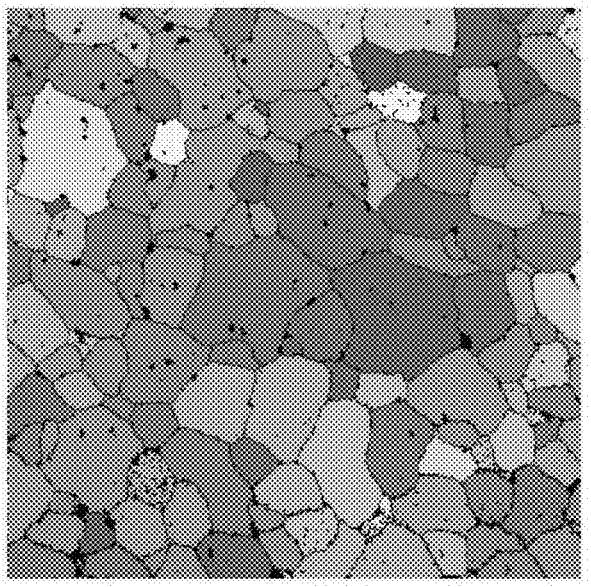
FIG. 2 is a view schematically illustrating an orientation mapping chart of measurement with SEM-EBSP of a same part as the SEM-reflected electron image illustrated in FIG. 1.

To recognize the crystal grain boundary, first a misorientation (misorientation as a reference) desired to be recognized is specified. The misorientation is specified by angle. Then, when the misorientation between adjacent pixels (measurement points) is larger than the specified reference, the existence of a grain boundary can be recognized there. For example, when the misorientation from a (0001) plane of 1-7 phase is specified as five degrees or more, a part where the crystal orientation is disordered (misorientation is more than five degrees) can be recognized as the crystal grain boundary. FIG. 2 schematically illustrates an orientation mapping chart of measurement with SEM-EBSP of the same part as the SEM-reflected electron image of FIG. 1. The orientation mapping chart is displayed with colors, but here it is illustrated as a gray-scale image for convenience. It can be seen that the crystal grain boundaries which are difficult to observe in the SEM-reflected electron image (FIG. 1) have a certain area in the orientation mapping chart of SEM-EBSP (FIG. 2). That is, it can be seen that there exists a crystal defect which does not contribute to magnetization of the boundary of crystal grains. The present inventors focused attention on the ratio of the crystal grain boundary as the above-described crystal defect, and have finally found a method of improving magnetization by studying a correlation with magnetic characteristics.

The structure observation with SEM and the measurement with SEM-EBSP are performed with respect to the inside of the sintered compact. The measurement of the inside of the sintered compact is as follows. Specifically, in a center portion of a longest side on a surface having a largest area, the measurement is performed in a surface portion and an inside portion of a cross section taken perpendicular to the side (or perpendicular to a tangential line of the center portion when it is a curved line). As positions of measurement, there are provided a reference line 1 drawn perpendicular to a side and inward to an end portion from a position of ½ of each side on the above cross section as a start point, and a reference line 2 drawn inward to an end portion from a center of each corner as a start point at a position of ½ of the internal angle of the corner, and the position of 1% of the length of the reference line from the start point of each of these reference lines 1, 2 is defined as a surface portion and the position of 40% thereof is defined as an inside portion. When the corner has a curvature by chamfering or the like, the intersecting point of extended adjacent sides is taken as an end portion (center of the corner) of the side. In this case, the measurement position is a position not from the intersecting point but from a portion in contact with the reference line.

By setting the measurement positions as above, when the cross section is a quadrangle for example, there are four reference lines 1 and four reference lines 2, eight reference lines in total, and there are eight measurement positions each as the surface portion and the inside portion. In this embodiment, it is preferred that all the eight positions each as the surface portion and the inside portion satisfy the above prescriptions of crystal grain diameter and grain boundary ratios, but it will suffice if at least four or more positions each as the surface portion and the inside portion fall within the above prescriptions. In this case, the relation between the surface portion and the inside portion on one reference line is not defined. An observation surface defined thus in the sintered compact is smoothed by polishing and then observed.

A specific procedure to obtain an average grain area and an average grain diameter (average grain diameter) of crystal grains existing in the measurement area will be described below. The observation is performed on a cross section perpendicular to the easy magnetization axis of 2-17 phase ([0001] direction of 1-7 phase/c-axis direction) as the cell phase with respect to the sintered compact oriented in a magnetic field. This cross section is defined as an ND plane. In an ideally oriented sample, the (0001) plane of all the crystal grains is in a parallel relation with the ND plane (that is, the [0001] direction is perpendicular to the ND plane).

First, as a pre-treatment of the observation plane of the sample, the sample is embedded in an epoxy resin and mechanically polished and buffed, and then water washing and water spraying with an air blow are performed. The sample after sprayed with water is surface processed by a dry etching apparatus. Next, the sample surface is observed with a scanning electron microscope S-4300SE (made by Hitachi High-Technologies Corporation) to which an EBSD system-Digiview (made by TSL) is attached. Observation conditions are acceleration voltage of 30 kV and measurement area of 500 micrometer×500 micrometer. As the observation magnification, desirably, 150 times is a reference. However, when there are less than 15 crystal grains in the measurement area (500 micrometer×500 micrometer), desirably, the observation magnification is set to 250 times, and the measurement area is 800 micrometer×800 micrometer. From the observation result, the average grain area and the average grain diameter of crystal grains existing within the range of the measurement area are obtained under the following conditions.

Directions of all pixels within the measurement area range are measured by step size of 2 micrometer, and a boundary where the misorientation between adjacent pixels is 5 degrees or more is assumed as the crystal grain boundary. However, a crystal grain whose measurement point included in the same crystal grain is less than five points and a crystal grain which reached an end portion in the measurement area range are not assumed as a crystal grain. The grain area is an area in the same crystal grain surrounded by a crystal grain boundary, and an average grain area is an average value of an area (grain area) of a crystal grain existing within the measurement area range. A grain diameter is a diameter of a true circle having the same area as an area of one crystal grain, and the average grain diameter is an average value of grain diameters of crystal grains existing in the measurement area range.

The ratio of crystal grain boundary in an arbitrary area within the observation area is obtained under the following conditions. First, directions of all pixels within the measurement area range are measured by step size of 2 micrometer, and a boundary where the misorientation between adjacent pixels is 5 degrees or more is assumed as the crystal grain boundary. Note that one with two or more coupled pixels is assumed as a crystal grain. Next, within the arbitrary area, the ratio of crystal grain boundary is calculated by image analysis using a contrast difference from the inside of the crystal grain. Pixels in which the contrast difference between the inside of the crystal grain and the crystal grain boundary cannot be distinguished may be compensated in advance by software.

Figure 3:
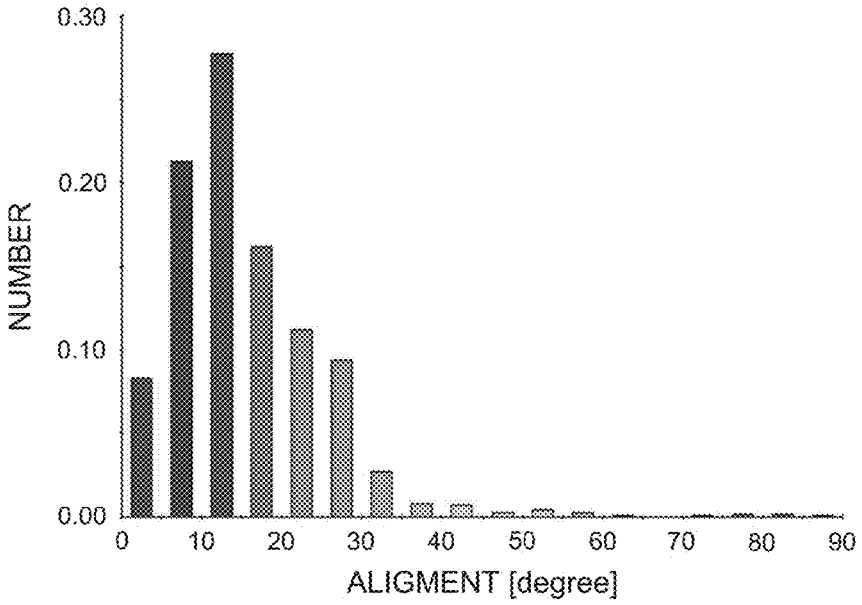
FIG. 3 is a frequency distribution diagram illustrating a displacement of a crystal orientation angle from an easy magnetization axis of a [0001] direction of crystal grains in the Sm—Co sintered magnet.

By evaluating a displacement of crystal orientation angle obtained when measurement is performed with the above-described SEM-EBSP, the degree of orientation of crystal grains can be evaluated. First, on the above-described orientation mapping chart of SEM-EBSP with the ND plane being an observation plane, most of the crystal grains should be ones with the (0001) plane being in a parallel relation with the ND plane (that is, the [0001] direction is perpendicular to the ND plane). Next, a displacement of the [0001] direction of 1-7 phase from the easy magnetization axis direction (ND direction) is evaluated. FIG. 3 illustrates an example of a graph on which a displacement of the crystal orientation angle of the [0001] direction of crystal grains from the easy magnetization axis direction (ND direction) is represented as a frequency distribution. In this graph, a crystal grain with a displacement of the crystal orientation angle of the [0001] direction being 45 degrees or more is defined as a grain that is not oriented (non-oriented grain). When an interval between non-oriented grains is large, the residual magnetization tends to be large.

The non-oriented grains can be eliminated by being encroached by surrounding grains through the processes of sintering and solution treatment. However, when many non-oriented grains exist densely in the initial stage of sintering, surrounding grains of the non-oriented grains are rather dragged to the non-oriented grains, and the degree of orientation may worsen. That is, a long distance between the non-oriented grains means a high degree of orientation of the crystal grains. Specifically, when an average distance L between the non-oriented grains (average distance between crystal grains with [0001] direction being inclined by 45 degrees or more) is 120 micrometer or more, the effect of improving residual magnetization due to improvement of the degree of orientation of crystal grains can be obtained more clearly. The average distance L between non-oriented grains is obtained as follows.

Figure 4:
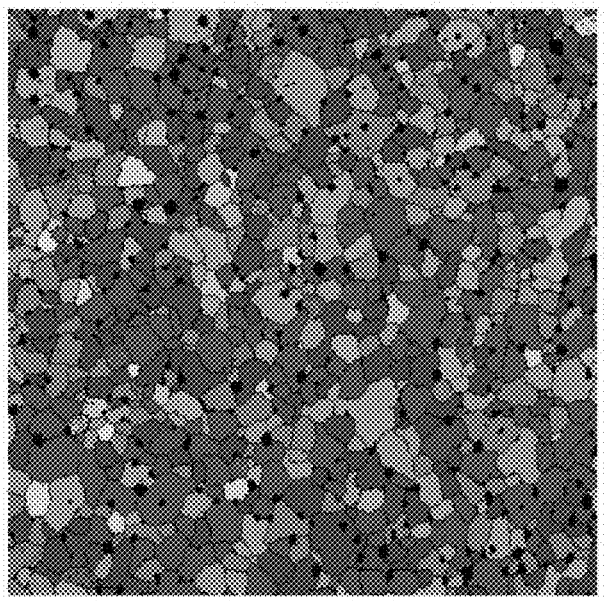
FIG. 4 is a view schematically illustrating a frequency distribution mapping chart based on a frequency distribution of the displacement of the crystal orientation angle illustrated in FIG. 3.

First, a displacement of a crystal orientation angle of the [0001] direction from the ND direction is mapped. FIG. 4 schematically illustrates a frequency distribution mapping chart based on a frequency distribution of the displacement of the crystal orientation angle illustrated in FIG. 3. Next, one arbitrary non-oriented grain on the frequency distribution mapping chart is selected. It is taken as a non-oriented grain 1. Next, a non-oriented grain at a shortest distance from the non-oriented grain 1 is found. This non-oriented grain at the shortest distance is taken as a non-oriented grain 2. Then, the distance between the non-oriented grain 1 and the non-oriented grain 2 is measured. Next, except the non-oriented grain 1, a non-oriented grain at a shortest distance from the non-oriented grain 2 is found. This non-oriented grain at the shortest distance is taken as a non-oriented grain 3. The distance between the non-oriented grain 2 and the non-oriented grain 3 is measured. This operation is performed until a non-oriented grain 15 is obtained, and an average value of measured distances is taken as the distance L1 between the non-oriented grains. This operation is performed at three positions of different fields of view, and an obtained average value of distances L1 to L3 between the non-oriented grains is defined as an average distance L between the non-oriented grains, that is, average distance between crystal grains with a displacement angle of the [0001] direction is 45 degrees or more.

The permanent magnet of this embodiment is produced as follows for example. First, an alloy powder containing a predetermined amount of elements is prepared. The alloy powder is prepared by, for example, forming an alloy ingot by casting a molten metal melted by an arc melting method or a high-frequency melting method, and pulverizing the alloy ingot. Other methods for preparing the alloy powder include a strip cast method, a mechanical alloying method, a mechanical grinding method, a gas-atomization method, a reduction diffusion method, and the like, and an alloy powder prepared by one of them may be used. To an alloy powder obtained thus or an alloy before being pulverized, a heat treatment may be performed as necessary for homogenization. Pulverization of the flake or ingot is performed by using a jet mill, a ball mill, or the like. To prevent oxidation of the alloy powder, preferably, the pulverization is performed in an inert gas atmosphere or an organic solvent.

The average grain diameter of the alloy powder after pulverization is preferably in the range of 2 to 5 micrometer, and moreover, a volume ratio of grains whose grain diameter is in the range of 2 to 10 micrometer is more preferably 80% or more of the whole powder. The alloy powder having such a grain diameter can be easily oriented in a magnetic field. The pulverization is preferably performed by a jet mill. With a ball mill, fine powder generated during the pulverization cannot be removed, and thus even when the average grain diameter is in the range of 2 to 5 micrometer, many sub-micron level particles are contained. Aggregation of such fine particles makes the powder difficult to be oriented in a magnetic field. Moreover, the fine particles become a factor for increase in amount of oxides in the sintered compact, and may decrease the coercive force.

When the iron concentration in the magnet composition is 24 atomic % or more, the volume ratio of particles with a grain diameter exceeding 10 micrometer is more preferably 10% or less in the alloy powder after pulverization. When the iron concentration is 24 atomic % or more, the amount of hetero-phase in the alloy ingot increases. The hetero-phase tends to increase not only in amount but also in size, and may become 20 micrometer or larger. When such an ingot is pulverized, if particles of 15 micrometer or larger exist for example, this particle may become a hetero-phase particle as it is. Such a hetero-phase particle remains even after sintering, and causes decrease in coercive force, decrease in magnetization, decrease in squareness, and the like. From such points, it is preferred to decrease the ratio of coarse particles.

Next, the alloy powder is filled in a metal mold placed in an electromagnet or the like, and press molding is performed while applying a magnetic field, to thereby produce a compression-molded body with oriented crystal axes. By sintering this compression-molded body under appropriate conditions, it is possible to obtain a sintered compact with high density. In order to increase density of the sintered compact, preferably, sintering of the compression-molded body is performed by combining sintering in a vacuum atmosphere and sintering in an inert gas atmosphere of Ar gas or the like. In this case, preferably, first the compression-molded body is heated to a predetermined temperature in a vacuum atmosphere, the sintering atmosphere is then switched from the vacuum atmosphere to the inert gas atmosphere, and thereafter sintering is performed by heating to a predetermined sintering temperature.

Preferably, the sintering temperature is in the range of 1110 degrees centigrade to 1190 degrees centigrade. Preferably, the retention time (sintering time) at the sintering temperature is in the range of 6 to 20 hours. When the sintering temperature exceeds 1190 degrees centigrade, evaporation of Sm and the like occurs easily. When the sintering temperature is lower than 1110 degrees centigrade, it is not possible to obtain a fine sintered compact. When the sintering temperature exceeds 1190 degrees centigrade, Sm and the like in the alloy powder evaporate excessively and thereby a composition displacement occurs, and it is possible that favorable magnetic characteristics cannot be obtained. More preferably, the sintering temperature is 1150 degrees centigrade or higher, furthermore preferably 1165 degrees centigrade or higher. Also, more preferably, the sintering temperature is 1185 degrees centigrade or lower.

To decrease the ratio of crystal grain boundary by growing crystal grains, the sintering time is preferably 6 hours or more. When the sintering time is less than 6 hours, it is not possible to grow the crystal grains sufficiently, and accompanying this, the ratio of crystal grain boundary increases easily. By these, it is possible that magnetization of the sintered magnet cannot be increased sufficiently. Moreover, unevenness in density occurs, and the magnetization decreases easily also by this. When the sintering time exceeds 20 hours, the amount of evaporation of Sm and the like increases and it is possible that composition control becomes difficult. More preferably, the sintering time is 8 hours or more, furthermore preferably 10 hours or more. Also, more preferably, the sintering time is 16 hours or less, and furthermore preferably 14 hours or less. From the point of preventing oxidation, preferably, the sintering is performed in a vacuum atmosphere or an inert gas atmosphere.

Next, the solution treatment is performed on the obtained sintered compact to control the crystal structure. The solution treatment may be performed sequentially from the sintering. Preferably, the solution treatment is performed by retaining for 6 to 28 hours at temperatures in the range of 1100 degrees centigrade to 1190 degrees centigrade, so as to obtain the 1-7 phase as the precursor of the phase separation structure. At temperatures lower than 1100 degrees centigrade and temperatures higher than 1190 degrees centigrade, the ratio of the 1-7 phase in the sample after the solution treatment becomes small, and good magnetic characteristics cannot be obtained. The solution treatment temperatures are more preferably in the range of 1120 degrees centigrade to 1180 degrees centigrade, furthermore preferably in the range of 1120 degrees centigrade to 1170 degrees centigrade.

The solution treatment time also influences the growth of grains, and when this time is short, the ratio of crystal grain boundary cannot be decreased sufficiently. Moreover, the constituent phases become uneven, and the coercive force may decrease. Accordingly, the retention time at the solution treatment temperature is preferably 6 hours or more. However, when the retention time at the solution treatment temperature is too long, the amount of evaporation of Sm and the like increases and composition control may become difficult. Thus, preferably, the retention time at the solution treatment temperature is 28 hours or less. The solution treatment time is more preferably in the range of 12 to 24 hours, furthermore preferably in the range of 14 to 18 hours. To prevent oxidation, preferably, the solution treatment is performed in a vacuum or an inert gas atmosphere of argon gas or the like.

As described above, in order to decrease the ratio of crystal grain boundary by growing the crystal grains, it is preferred not only to extend the sintering time but also to extend the solution treatment time. Thus, preferably, the sintering time and the solution treatment time are both six hours or more. Besides that, preferably, the total time of the sintering time and the solution treatment time is 16 hours or more. That is, when the sintering time is six hours, the solution treatment time is preferably 10 hours or more. When the solution treatment time is six hours, the sintering time is preferably 10 hours or more. When the total time of them is less than 16 hours, it is possible that the ratio of crystal grain boundary cannot be decreased sufficiently, and also the degree of orientation cannot be increased sufficiently. More preferably, the total time of the sintering time and the solution treatment time is 19 hours or more, further preferably 22 hours or more.

The solution treatment step is preferably such that rapid cooling is performed after retaining at the above-described temperatures for a certain time. This rapid cooling is performed for maintaining the 1-7 phase, which is a metastable phase, also at room temperature. When the sintering and the solution treatment are performed for a long time, it is possible that it becomes difficult for the 1-7 phase to stabilize. At that time, by setting the cooling rate to −170 degrees centigrade/min or higher, the 1-7 phase stabilizes easily, and coercive force can be exerted easily. Moreover, when the cooling rate is lower than −170 degrees centigrade/min, a $Ce_2Ni_7$ crystal phase (2-7 phase) may be generated during the cooling. This phase may become a factor for decrease in magnetization and coercive force. Cu is often thickened in the 2-7 phase, and this decreases the Cu concentration in the main phase, making it difficult for phase separation into the cell phase and the cell wall phase by an aging treatment to occur.

Next, an aging treatment is performed on the sintered compact after the solution treatment. The aging treatment is for controlling crystal structures to increase the coercive force of the magnet. Preferably, the aging treatment is such that the sintered compact is retained for 0.5 to 80 hours at temperatures of 700 degrees centigrade to 900 degrees centigrade, slowly cooled thereafter at a cooling rate of 0.2 degrees centigrade to 2 degrees centigrade/minute to temperatures of 400 degrees centigrade to 650 degrees centigrade, and cooled subsequently to room temperature by furnace cooling. The aging treatment may be performed by heat treatments of two stages. For example, the above heat treatment is the first stage, and thereafter as a heat treatment of the second stage, it is retained for a certain time at temperatures of 400 degrees centigrade to 650 degrees centigrade, and is subsequently cooled to room temperature by furnace cooling. The coercive force may thus be improved. Preferably, the retention time is in the range of 1 to 6 hours. For preventing oxidation, preferably, the aging treatment is performed in a vacuum or an inert gas atmosphere.

When the aging treatment temperature is lower than 700 degrees centigrade or higher than 900 degrees centigrade, a homogeneous mixed structure of the cell phase and the cell wall phase cannot be obtained, and thus magnetic characteristics of the permanent magnet may decrease. The aging treatment temperature is more preferably 750 degrees centigrade to 880 degrees centigrade, furthermore preferably 780 degrees centigrade to 850 degrees centigrade. When the aging treatment time is less than 0.5 hour, it is possible that precipitation of the cell wall phase from the 1-7 phase does not complete sufficiently. On the other hand, when the aging treatment time exceeds 80 hours, it is possible that the thickness of the cell wall phase becomes large, and hence the volume fraction of the cell phase decreases. This becomes a factor for decrease in magnetic characteristics. The aging treatment time is more preferably in the range of 4 to 60 hours, furthermore preferably in the range of 8 to 40 hours.

When the cooling rate after the aging heat treatment is less than 0.2 degrees centigrade/minute, the thickness of the cell wall phase becomes large, and hence the volume fraction of the cell phase may decrease. On the other hand, when the cooling rate after the aging heat treatment exceeds 2 degrees centigrade/minute, it is possible that a homogeneous mixed structure of the cell phase and the cell wall phase cannot be obtained. In either case, it is possible that magnetic characteristics of the permanent magnet cannot be increased sufficiently. More preferably, the cooling rate after the aging heat treatment is in the range of 0.4 degrees centigrade to 1.5 degrees centigrade/minute, furthermore preferably in the range of 0.5 degrees centigrade to 1.3 degrees centigrade/minute.

Note that the aging treatment is not limited to the heat treatment of two stages and may be a heat treatment of more stages, or it is further effective to perform cooling of multiple stages. Further, as a pre-treatment before the aging treatment, it is also effective to perform a preliminary aging treatment at lower temperatures and for a shorter time (preliminary aging treatment) than in the aging treatment. Thus, improvement of squareness of a magnetization curve is expected. Specifically, improvement of squareness of the permanent magnet is expected when the temperature of the preliminary aging treatment is in the range of 650 degrees centigrade to 790 degrees centigrade, the treatment time is in the range of 0.5 to 4 hours, and the slow cooling rate after the aging treatment is in the range of 0.5 degrees centigrade to 1.5 degrees centigrade/min.

The permanent magnet of the embodiment can be used for various motors and generators. Further, it is possible to use the permanent magnet as a stationary magnet or a variable magnet of a variable magnetic flux motor or a variable magnetic flux generator. Various motors and generators are formed using the permanent magnet of this embodiment. When the permanent magnet of this embodiment is applied to a variable magnetic flux motor, technologies disclosed in Japanese Patent Application Laid-open No. 2008-29148 or Japanese Patent Application Laid-open No. 2008-43172 can be applied to the structure and/or drive system of the variable magnetic flux motor.

Figure 5:
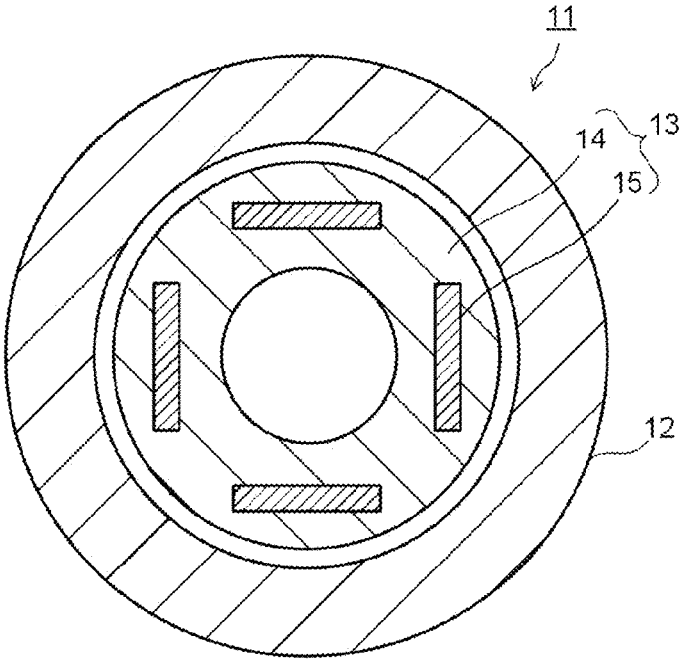
FIG. 5 is a view illustrating a permanent magnet motor of an embodiment.

Next, a motor and a generator of the embodiment will be described with reference to the drawings. FIG. 5 illustrates a permanent magnet motor according to the embodiment. In the permanent magnet motor 11 illustrated in FIG. 5, a rotor 13 is disposed in a stator 12. In an iron core 14 of the rotor 13, permanent magnets 15 of the embodiment are disposed. Based on characteristics and the like of the permanent magnets of the embodiment, high efficiency, miniaturization, and cost reduction of the permanent magnet motor 11 can be achieved.

Figure 6:
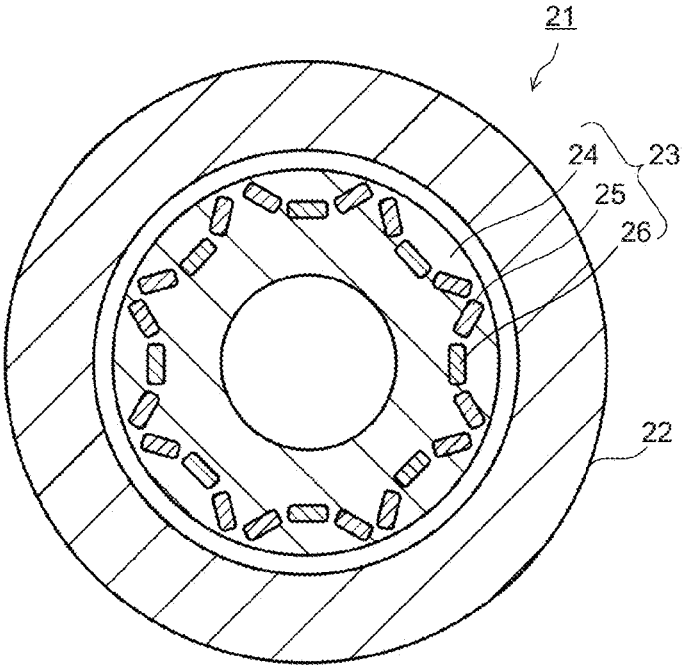
FIG. 6 is a view illustrating a variable magnetic flux motor of the embodiment.

FIG. 6 illustrates a variable magnetic flux motor of the embodiment. In the variable magnetic flux motor 21 illustrated in FIG. 6, a rotor 23 is disposed in a stator 22. In an iron core 24 of the rotor 23, the permanent magnet of the embodiment is disposed as stationary magnets 25 and variable magnets 26. The magnetic flux density (magnetic flux amount) of the variable magnets 26 is variable. The magnetization direction of the variable magnets 26 is orthogonal to a Q-axis direction and hence is not affected by a Q-axis current, and can be magnetized by a D-axis current. A magnetization winding (not illustrated) is provided on the rotor 23. It is structured such that by passing an electric current from a magnetization circuit through this magnetization winding, the magnetic field thereof operates directly on the variable magnets 26.

The permanent magnet of the embodiment enables to obtain, for example, stationary magnets 25 whose coercive force exceeds 500 kA/m and variable magnets 26 whose coercive force is 500 kA/m or less by changing the above-described various conditions of the manufacturing method. Note that in the variable magnetic flux motor 21 illustrated in FIG. 6, the permanent magnet of the embodiment can be used for both the stationary magnets 25 and the variable magnets 26, but the permanent magnet of the embodiment may be used for either one of the magnets. The variable magnetic flux motor 21 is capable of outputting large torque from a small device size, and thus is preferred for a motor of a hybrid vehicle, electric vehicle, or the like required to have high output and small size of the motor.

Figure 7:
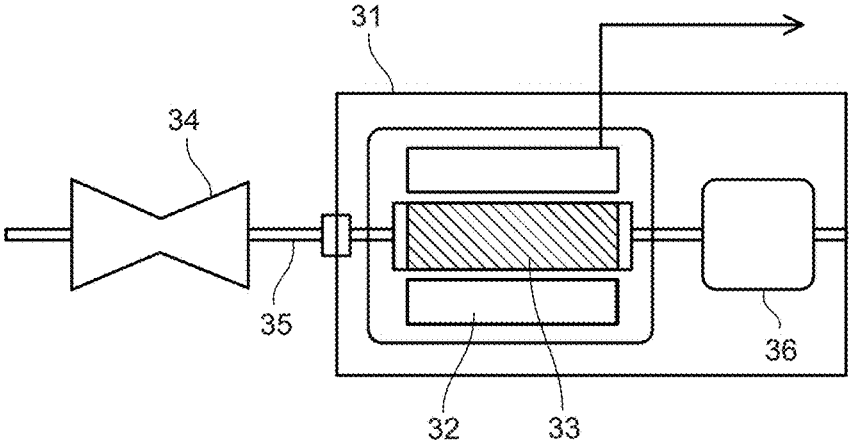
FIG. 7 is a diagram illustrating a permanent magnet generator of the embodiment.

FIG. 7 illustrates a generator according to the embodiment. The generator 31 illustrated in FIG. 7 includes a stator 32 using the permanent magnet of the embodiment. A rotor 33 disposed inside the stator 32 is coupled to a turbine 34 provided on one end of the generator 31 via a shaft 35. The turbine 34 is rotated by, for example, fluid supplied from the outside. Note that instead of the turbine 34 rotated by fluid, it is also possible to rotate the shaft 35 by transmitting dynamic rotations of regenerative energy or the like of an automobile. Various publicly known structures may be employed for the stator 32 and the rotor 33.

The shaft 35 is in contact with a commutator (not illustrated) disposed on the opposite side of the turbine 34 with respect to the rotor 33, and electromotive force generated by rotations of the rotor 33 is increased in voltage to a system voltage and transmitted as output of the generator 31 via isolated phase buses and a main transformer (not illustrated). The generator 31 may be either of an ordinary generator and a variable magnetic flux generator. Incidentally, static electricity from the turbine 34 or charges by an axial current accompanying power generation occur on the rotor 33. Accordingly, the generator 31 has a brush 36 for discharging the charges of the rotor 33.

Next, specific examples and evaluation results thereof will be described.

Examples 1 and 2

After weighing respective materials to be of a composition illustrated in Table 1, they were arc melted in an Ar gas atmosphere to produce an alloy ingot. The alloy ingot was coarsely winded and further pulverized with a jet mill, to thereby prepare an alloy powder. The alloy powder was press molded in a magnetic field to produce a compression-molded body. The compression-molded body of the alloy powder was placed in a chamber of a firing furnace, and the chamber was evacuated until the degree of vacuum in the chamber becomes $9.5\times10^{-3}$ Pa. The temperature in the chamber was increased to 1165 degrees centigrade in this state and it was retained at this temperature for five minutes, and thereafter Ar gas was introduced into the chamber.

Next, the temperature in the chamber in an Ar atmosphere was increased to 1190 degrees centigrade, sintering was performed by retaining at this temperature for six hours, a solution treatment was performed subsequently by retaining at 1160 degrees centigrade for 12 hours, and thereafter it was cooled to room temperature at a cooling rate of −240 degrees centigrade/min. The sintered compact after the solution treatment was retained at 710 degrees centigrade for one hour, and thereafter slowly cooled to room temperature. Subsequently, the sintered compact was retained at 810 degrees centigrade for 42 hours. The sintered compact on which the aging treatment was performed under such conditions was slowly cooled to 450 degrees centigrade and furnace cooled to room temperature after retaining at this temperature for three hours, thereby obtaining a target sintered magnet. Conditions of manufacturing sintered compacts (processing conditions of the sintering step and the solution treatment step) are illustrated in Table 2.

Compositions of the sintered magnets are as illustrated in Table 1. A composition analysis for the magnets was performed by an Inductively Coupled Plasma (ICP) method. According to the above-described method, the average grain diameter of the sintered magnets (sintered compacts), the volume fraction of crystal grain boundary, and the average distance L between non-oriented grains were measured. Moreover, magnetic characteristics of the sintered magnets were evaluated with a BH tracer, and coercive force and residual magnetization were measured. Measurement results thereof are illustrated in Table 3. The composition analysis by the ICP method was performed following the procedure below. First, a predetermined amount of a sample pulverized in a mortar is weighed and put into a quartz beaker. A mixed acid (containing a nitric acid and a hydrochloric acid) is put therein, and the beaker is heated to about 140 degrees centigrade on a hot plate, so as to completely melt the sample. After letting cool, the sample is moved to a PFA volumetric flask to have a constant volume, which is a sample solution. In such a sample solution, contained components are quantitated by a calibration curve method using an ICP emission spectrophotometer. As the ICP emission spectrophotometer, SPS4000 (product name) made by SII Nano Technology was used.

Examples 3 to 5

After weighing respective materials to be of a composition illustrated in Table 1, they were high-frequency melted in an Ar gas atmosphere to produce an alloy ingot. The alloy ingot was coarsely grinded, heat treated under the condition of 1170 degrees centigrade×two hours, and thereafter rapidly cooled to room temperature. It was pulverized with a jet mill to thereby prepare an alloy powder. The alloy powder was press molded in a magnetic field to produce a compression-molded body. The compression-molded body of the alloy powder was placed in a chamber of a firing furnace, and the chamber was evacuated until the degree of vacuum in the chamber becomes $9.0\times10^{-3}$ Pa. The temperature in the chamber was increased to 1160 degrees centigrade in this state and it was retained at this temperature for ten minutes, and thereafter Ar gas was introduced into the chamber. The temperature in the chamber in an Ar atmosphere was increased to 1180 degrees centigrade, sintering was performed by retaining at this temperature for 16 hours, a solution treatment was performed subsequently by retaining at 1120 degrees centigrade for 10 hours, and thereafter it was cooled to room temperature at a cooling rate of −250 degrees centigrade/min.

Next, the sintered compact after the solution treatment was retained at 750 degrees centigrade for 1.5 hour, and thereafter slowly cooled to room temperature. Subsequently, the sintered compact was retained at 800 degrees centigrade for 38 hours. The sintered compact on which the aging treatment was performed under such conditions was slowly cooled to 350 degrees centigrade and furnace cooled to room temperature after retaining at this temperature for two hours, thereby obtaining a target sintered magnet. Conditions of manufacturing sintered compacts (processing conditions of the sintering step and the solution treatment step) are illustrated in Table 2. Compositions of the sintered magnets are as illustrated in Table 1. The average grain diameter of the sintered magnets (sintered compacts), the volume fraction of crystal grain boundary, the average distance L between non-oriented grains, the coercive force, and the residual magnetization were measured similarly to example 1. Measurement results thereof are illustrated in Table 3.

Examples 6 and 7

After weighing respective materials to be of a composition illustrated in Table 1, they were high-frequency melted in an Ar gas atmosphere to produce an alloy ingot. The alloy ingot was coarsely grinded, heat treated under the condition of 1130 degrees centigrade×two hours, and thereafter rapidly cooled to room temperature. It was pulverized with a jet mill to thereby prepare an alloy powder. The alloy powder was press molded in a magnetic field to produce a compression-molded body. The compression-molded body of the alloy powder was placed in a chamber of a firing furnace, and the chamber was evacuated until the degree of vacuum in the chamber becomes $7.5\times10^{-3}$ Pa. The temperature in the chamber was increased to 1150 degrees centigrade in this state and it was retained at this temperature for 25 minutes, and thereafter Ar gas was introduced into the chamber. The temperature in the chamber in an Ar atmosphere was increased to 1180 degrees centigrade, sintering was performed by retaining at this temperature for 13 hours, a solution treatment was performed subsequently by retaining at 1130 degrees centigrade for 24 hours, and thereafter it was cooled to room temperature at a cooling rate of −260 degrees centigrade/min.

Next, the sintered compact after the solution treatment was retained at 690 degrees centigrade for one hour, and thereafter slowly cooled to room temperature. Subsequently, the sintered compact was retained at 830 degrees centigrade for 45 hours. The sintered compact on which the aging treatment was performed under such conditions was slowly cooled to 300 degrees centigrade and furnace cooled to room temperature after retaining at this temperature for four hours, thereby obtaining a target sintered magnet. Compositions of the sintered magnets are as illustrated in Table 1. The average grain diameter of the sintered magnets (sintered compacts), the volume fraction of crystal grain boundary, the average distance L between non-oriented grains, the coercive force, and the residual magnetization were measured similarly to example 1. Measurement results thereof are illustrated in Table 3.

Examples 8 to 11

After weighing respective materials to be of a composition illustrated in Table 1, they were high-frequency melted in an Ar gas atmosphere to produce an alloy ingot. The alloy ingot was coarsely grinded, heat treated under the condition of 1170 degrees centigrade×two hours, and thereafter rapidly cooled to room temperature. It was pulverized with a jet mill to thereby prepare an alloy powder. The alloy powder was press molded in a magnetic field to produce a compression-molded body. The compression-molded body of the alloy powder was placed in a chamber of a firing furnace, and the chamber was evacuated until the degree of vacuum in the chamber becomes $9.0\times10^{-3}$ Pa. The temperature in the chamber was increased to 1160 degrees centigrade in this state and it was retained at this temperature for five minutes, and thereafter Ar gas was introduced into the chamber. Then, the sintering step and the solution treatment step were performed under the conditions illustrated in Table 2. The cooling rate after the solution treatment was −180 degrees centigrade/min.

Next, the sintered compact after the solution treatment was retained at 720 degrees centigrade for two hours, and thereafter slowly cooled to room temperature. Subsequently, the sintered compact was retained at 820 degrees centigrade for 35 hours. The sintered compact on which the aging treatment was performed under such conditions was slowly cooled to 350 degrees centigrade and furnace cooled to room temperature after retaining at this temperature for 1.5 hour, thereby obtaining a target sintered magnet. Compositions of the sintered magnets are as illustrated in Table 1. The average grain diameter of the sintered magnets (sintered compacts), the volume fraction of crystal grain boundary, the average distance L between non-oriented grains, the coercive force, and the residual magnetization were measured similarly to example 1. Measurement results thereof are illustrated in Table 3.

Comparative Examples 1 and 2

Except that compositions illustrated in Table 1 are applied, sintered magnets were produced similarly to example 1. In comparative example 1, the Sm concentration in the alloy composition exceeds 12.5 atomic %, and in comparative example 2, the Zr concentration in the alloy composition exceeds 4.5 atomic %. The average grain diameter of the sintered magnets (sintered compacts), the volume fraction of crystal grain boundary, the average distance L between non-oriented grains, the coercive force, and the residual magnetization were measured similarly to example 1. Measurement results thereof are illustrated in Table 3.

Comparative Example 3

After weighing respective materials to be of a composition illustrated in Table 1, they were high-frequency melted in an Ar gas atmosphere to produce an alloy ingot. The alloy ingot was coarsely grinded, heat treated under the condition of 1170 degrees centigrade×two hours, and thereafter rapidly cooled to room temperature. It was pulverized with a jet mill to thereby prepare an alloy powder. The alloy powder was press molded in a magnetic field to produce a compression-molded body. The compression-molded body of the alloy powder was placed in a chamber of a firing furnace, and the chamber was evacuated until the degree of vacuum in the chamber becomes $9.0\times10^{-3}$ Pa. The temperature in the chamber was increased to 1160 degrees centigrade in this state and it was retained at this temperature for five minutes, and thereafter Ar gas was introduced into the chamber. The temperature in the chamber in an Ar atmosphere was increased to 1210 degrees centigrade, sintering was performed by retaining at this temperature for six hours, a solution treatment was performed subsequently by retaining at 1130 degrees centigrade for 12 hours, and thereafter it was cooled to room temperature at a cooling rate of −180 degrees centigrade/min.

Next, the sintered compact after the solution treatment was retained at 720 degrees centigrade for two hours, and thereafter slowly cooled to room temperature. Subsequently, the sintered compact was retained at 820 degrees centigrade for 35 hours. The sintered compact on which the aging treatment was performed under such conditions was slowly cooled to 350 degrees centigrade and furnace cooled to room temperature after retaining at this temperature for 1.5 hour, thereby obtaining a target sintered magnet. Compositions of the sintered magnets are as illustrated in Table 1. The average grain diameter of the sintered magnets (sintered compacts), the volume fraction of crystal grain boundary, the average distance L between non-oriented grains, the coercive force, and the residual magnetization were measured similarly to example 1. Measurement results thereof are illustrated in Table 3.

Comparative Examples 4 to 6

A raw material mixture weighed to have the same composition as example 8 was used to prepare an alloy powder similarly to example 8. Then, the alloy powder was press molded in a magnetic field to produce a compression-molded body, and thereafter the sintering step and the solution treatment step were performed under the conditions illustrated in Table 2. Moreover, the aging treatment was performed under the same conditions as example 8, thereby producing a sintered magnet. The average grain diameter of the sintered magnets (sintered compacts), the volume fraction of crystal grain boundary, the average distance L between non-oriented grains, the coercive force, and the residual magnetization were measured similarly to example 1. Measurement results thereof are illustrated in Table 3.

TABLE 1

| | Magnet composition (atomic %) | | | | | |
|---|---|---|---|---|---|---|
| | Sm | Fe | Cu | Zr | Others | Co |
| Example 1 | 10.67 | 25.33 | 5.33 | 2.93 | Ce: 0.44 | Remaining Portion |
| Example 2 | 11.90 | 26.25 | 7.14 | 1.70 | Ti: 0.04 | Remaining Portion |
| Example 3 | 10.75 | 29.36 | 5.27 | 1.43 | Mn: 0.18 | Remaining Portion |
| Example 4 | 11.49 | 29.12 | 4.25 | 1.73 | Cr: 0.13 | Remaining Portion |
| Example 5 | 11.11 | 28.00 | 8.89 | 1.69 | Al: 0.105<br>Cr: 0.105 | Remaining Portion |
| Example 6 | 11.11 | 32.09 | 5.24 | 1.73 | — | Remaining Portion |
| Example 7 | 11.24 | 34.62 | 5.24 | 1.55 | — | Remaining Portion |
| Example 8 | 11.11 | 30.93 | 5.24 | 1.73 | — | Remaining Portion |
| Example 9 | 11.11 | 30.93 | 5.24 | 1.73 | — | Remaining Portion |
| Example 10 | 11.11 | 30.93 | 5.24 | 1.73 | — | Remaining Portion |
| Example 11 | 11.11 | 30.93 | 5.24 | 1.73 | — | Remaining Portion |
| Comparative Example 1 | 12.63 | 24.75 | 5.21 | 1.82 | Cr: 0.53 | Remaining Portion |
| Comparative Example 2 | 10.87 | 26.56 | 7.22 | 4.63 | Ti: 0.04 | Remaining Portion |
| Comparative Example 3 | 10.31 | 31.21 | 5.29 | 1.75 | — | Remaining Portion |
| Comparative Example 4 | 11.11 | 30.93 | 5.24 | 1.73 | — | Remaining Portion |

TABLE 1-continued

| | Magnet composition (atomic %) | | | | | |
|---|---|---|---|---|---|---|
| | Sm | Fe | Cu | Zr | Others | Co |
| Comparative Example 5 | 11.11 | 30.93 | 5.24 | 1.73 | — | Remaining Portion |
| Comparative Example 6 | 11.11 | 30.93 | 5.24 | 1.73 | — | Remaining Portion |

TABLE 2

| | Producing conditions of sintered compact | | | | |
|---|---|---|---|---|---|
| | Sintering step | | Solution treatment step | | Sintering time + solution |
| | Temperature [° C.] | Time [h] | Temperature [° C.] | Time [h] | treatment time [h] |
| Example 1 | 1190 | 6 | 1160 | 12 | 18 |
| Example 2 | 1190 | 6 | 1160 | 12 | 18 |
| Example 3 | 1180 | 16 | 1120 | 10 | 26 |
| Example 4 | 1180 | 16 | 1120 | 10 | 26 |
| Example 5 | 1180 | 16 | 1120 | 10 | 26 |
| Example 6 | 1180 | 13 | 1130 | 24 | 37 |
| Example 7 | 1180 | 13 | 1130 | 24 | 37 |
| Example 8 | 1190 | 6 | 1130 | 10 | 16 |
| Example 9 | 1190 | 10 | 1130 | 10 | 20 |
| Example 10 | 1190 | 6 | 1130 | 18 | 24 |
| Example 11 | 1190 | 10 | 1130 | 18 | 28 |
| Comparative Example 1 | 1190 | 6 | 1160 | 12 | 18 |
| Comparative Example 2 | 1190 | 6 | 1160 | 12 | 18 |
| Comparative Example 3 | 1210 | 6 | 1130 | 12 | 18 |
| Comparative Example 4 | 1190 | 4 | 1160 | 12 | 16 |
| Comparative Example 5 | 1190 | 12 | 1160 | 4 | 16 |
| Comparative Example 6 | 1190 | 7 | 1160 | 7 | 14 |

TABLE 3

| | Average crystal grain diameter [μm] | Volume fraction of crystal grain boundary [%] | Average distance between non-oriented grains [μm] | Residual magnetization Mr [T] | Coercive force iHc [kA/m] |
|---|---|---|---|---|---|
| Example 1 | 35 | 9.4 | 160 | 1.150 | 1590 |
| Example 2 | 33 | 10.1 | 142 | 1.195 | 1450 |
| Example 3 | 42 | 8.5 | 325 | 1.225 | 1220 |
| Example 4 | 44 | 8.2 | 310 | 1.220 | 1290 |
| Example 5 | 49 | 8.1 | 343 | 1.200 | 1180 |
| Example 6 | 55 | 7.8 | 359 | 1.255 | 1070 |
| Example 7 | 47 | 9.5 | 322 | 1.270 | 1010 |
| Example 8 | 29 | 12.5 | 129 | 1.240 | 1350 |
| Example 9 | 41 | 7.6 | 298 | 1.245 | 1340 |
| Example 10 | 38 | 7.4 | 214 | 1.245 | 1410 |
| Example 11 | 55 | 6.9 | 254 | 1.255 | 1400 |
| Comparative Example 1 | 33 | 10.5 | 151 | 1.105 | 450 |
| Comparative Example 2 | 36 | 11.1 | 137 | 1.120 | 700 |
| Comparative Example 3 | 110 | 5.9 | 88 | 1.080 | 380 |
| Comparative Example 4 | 22 | 20.2 | 79 | 1.205 | 1310 |
| Comparative Example 5 | 27 | 17.5 | 105 | 1.215 | 1290 |
| Comparative Example 6 | 24 | 15.1 | 114 | 1.215 | 1270 |

As is clear from Table 3, the sintered magnets of examples 1 to 11 all have appropriate average grain diameters and volume fractions of crystal grain boundary, from which it can be seen that they have both high magnetization and high coercive force. The permanent magnets of comparative examples 1, 2 have shifted compositions, and thus have not obtained sufficient magnetic characteristics. Since comparative example 3 is retained for a long time at a sintering temperature that is too high, the Sm concentration therein decreased, and hence the coercive force is small. Further, when the Sm concentration decreases, the sintering compact density also decreases, and hence the residual magnetization is also small. Comparative examples 4 to 6 for which the sintering temperature is low and the solution treatment time is short, the ratio of crystal grain boundary is large and the degree of orientation of crystal grains is low, and thus the magnetization is not improved sufficiently as compared to examples 8 to 11.

While certain embodiments have been described, these embodiments have been presented by way of example only, and are not intended to limit the scope of the inventions. Indeed, the novel methods described herein may be embodied in a variety of other forms; furthermore, various omissions, substitutions and changes in the form of the methods described herein may be made without departing from the spirit of the inventions. The accompanying claims and their equivalents are intended to cover such forms or modifications as would fall within the scope and spirit of the inventions.

What is claimed is:

1. A permanent magnet comprising a sintered compact, the sintered compact comprising:

a composition represented by the following composition formula:

$$R_pFe_qM_rCu_sCo_{100-p-q-r-s}$$

wherein R is at least one element selected from the group consisting of rare earth elements, M is at least one element selected from the group consisting of Zr, Ti, and Hf, p is 10.5 atomic % or more and 12.5 atomic % or less, q is 24 atomic % or more and 40 atomic % or less, r is 0.88 atomic % or more and 4.5 atomic % or less, and s is 3.5 atomic % or more and 10.7 atomic % or less; and a structure having crystal grains constituted of a main phase including a $Th_2Zn_{17}$ crystal phase, and a crystal grain boundary existing between the crystal grains, wherein an average grain diameter of the crystal grains is 25 micrometers or more, and a volume fraction of the crystal grain boundary is 5% or more and 14% or less, wherein, when the $Th_2Zn_{17}$ crystal phase is indexed as a $TbCu_7$ crystal phase, an average distance between crystal grains with a displacement angle of a [0001] direction of the $TbCu_7$ crystal phase being 45 degrees or more is 120 micrometers or more, and wherein a coercive force of the magnet is 1010 kA/m or more, and a residual magnetization of the magnet is 1.150 T or more and 1.270 T or less.

2. The permanent magnet of claim 1, wherein the average grain diameter of the crystal grains is 25 micrometers of more and 200 micrometer or less.

3. The permanent magnet of claim 1, wherein the main phase has a cell phase having the $Th_2Zn_{17}$ crystal phase and a cell wall phase existing in a form surrounding the cell phase.

4. The permanent magnet of claim 1, wherein 50 atomic % or more of the element R is Sm.

5. The permanent magnet of claim 1, wherein 50 atomic % or more of the element M is Zr.

6. The permanent magnet of claim 1, wherein 20 atomic % or less of the Co element is replaced with at least one kind of element A selected from the group consisting of Ni, V, Cr, Mn, Al, Si, Ga, Nb, Ta, and W.

7. A motor comprising the permanent magnet of claim 1.

8. A generator comprising the permanent magnet of claim 1.

9. A vehicle comprising the motor of claim 7.

10. A vehicle comprising the generator of claim 8.

11. A permanent magnet comprising a sintered compact, the sintered compact comprising:

a composition represented by the following composition formula:

$$R_pFe_qM_rCu_sCo_{100-p-q-r-s}$$

wherein R is at least one element selected from the group consisting of rare earth elements, M is at least one element selected from the group consisting of Zr, Ti, and Hf, p is 10.5 atomic % or more and 12.5 atomic % or less, q is 24 atomic % or more and 40 atomic % or less, r is 0.88 atomic % or more and 4.5 atomic % or less, and s is 3.5 atomic % or more and 10.7 atomic % or less; and a structure having crystal grains constituted of a main phase including a $Th_2Zn_{17}$ crystal phase, and a crystal grain boundary existing between the crystal grains, wherein, when the $Th_2Zn_{17}$ crystal phase is indexed as a $TbCu_7$ crystal phase, an average distance between crystal grains with a displacement angle of a [0001] direction of the $TbCu_7$ crystal phase being 45 degrees or more is 120 micrometers or more, and wherein a coercive force of the magnet is 1010 kA/m or more, and a residual magnetization of the magnet is 1.150 T or more and 1.270 T or less.

* * * * *